US009168549B2

(12) United States Patent
Slot

(10) Patent No.: US 9,168,549 B2
(45) Date of Patent: Oct. 27, 2015

(54) DEVICE FOR EJECTING DROPLETS OF AN ELECTRICALLY NON-CONDUCTIVE FLUID AT HIGH TEMPERATURE

(71) Applicant: OCE TECHNOLOGIES B.V., Venlo (NL)

(72) Inventor: Marcel Slot, Baarlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 114 days.

(21) Appl. No.: 13/785,249

(22) Filed: Mar. 5, 2013

(65) Prior Publication Data

US 2013/0181065 A1 Jul. 18, 2013

Related U.S. Application Data

(63) Continuation of application No. PCT/EP2011/068162, filed on Oct. 18, 2011.

(30) Foreign Application Priority Data

Nov. 5, 2010 (EP) ..... 10190109

(51) Int. Cl.
*B41J 2/045* (2006.01)
*B05B 9/00* (2006.01)
*B41J 2/06* (2006.01)

(52) U.S. Cl.
CPC . *B05B 9/002* (2013.01); *B41J 2/06* (2013.01); *B41J 2/04578* (2013.01); *B41J 2202/04* (2013.01)

(58) Field of Classification Search
CPC ..... B05C 5/001; B05B 9/002; B05B 7/162; B08B 2203/007; B41J 2/04; B41J 2002/041; B41J 2/06; B41J 2/04578; H05K 2203/128
USPC ..... 239/135, 139, 137, 690–708; 222/209, 222/214
See application file for complete search history.

(56) References Cited

U.S. PATENT DOCUMENTS 3,752,216 A * 8/1973 Fritsche ..... 164/509
5,320,250 A * 6/1994 La et al. ..... 222/1
6,368,375 B1 * 4/2002 Benz et al. ..... 75/10.25

(Continued)

FOREIGN PATENT DOCUMENTS

NL WO 2010/063576 * 6/2010 ..... B22F 9/08
NL WO2010063576 A1 * 6/2010
WO WO 2010/063576 A1 6/2010

*Primary Examiner* — Justin Jonaitis
*Assistant Examiner* — Juan C Barrera
(74) *Attorney, Agent, or Firm* — Birch, Stewart, Kolasch & Birch, LLP

(57) ABSTRACT

A device is configured to eject droplets of an electrically non-conductive medium at a temperature of 360° C. or above. The device includes a fluid chamber body, the fluid chamber body having a fluid chamber for containing an electrically non-conductive medium at a temperature of 360° C. or above and for containing a conductive medium. The fluid chamber includes an orifice. In the fluid chamber, at least a part of the electrically non-conductive medium is positioned closer to the orifice than the conductive medium. The device further includes a heater configured to heat the electrically non-conductive medium and an actuator, the actuator includes electrodes for generating a current in the conductive medium and magnets for generating a magnetic field in the conductive medium.

9 Claims, 3 Drawing Sheets

(56) References Cited

U.S. PATENT DOCUMENTS 7,588,622 B2 * 9/2009 Chow ..... 75/331
2004/0056048 A1 * 3/2004 Kaartinen ..... 222/214
2005/0243144 A1 11/2005 Dean, Jr. et al.

* cited by examiner

DEVICE FOR EJECTING DROPLETS OF AN ELECTRICALLY NON-CONDUCTIVE FLUID AT HIGH TEMPERATURE

CROSS-REFERENCE TO RELATED APPLICATIONS

This application is a Continuation of PCT International Application No. PCT/EP2011/068162 filed on Oct. 18, 2011, which claims priority under 35 U.S.C. §119(a) to patent application Ser. No. 10190109.8 filed in Europe on Nov. 5, 2010. The entire contents of each of the above documents is hereby incorporated by reference in to the present application.

The invention relates to a device for ejecting droplets of an electrically non-conductive fluid at high temperature.

BACKGROUND OF THE INVENTION

A device for ejecting droplets of a fluid, for example an ink jet printer, is well known in the art, see for an overview for example Stephen F. Pond, Inkjet Technology and Development Strategies, Torrey Pines Research, 2000. In such a device, droplets are ejected through an orifice by applying a force on a fluid. The device comprises at least one orifice provided with an electromechanical transducer. The best known examples of electromechanical transducers are thermal transducers and piezoelectric transducers. In the piezoelectric ink jet technique, a piezoelectric element deforms under the influence of an electric pulse. The bending deformation of the piezoelectric element generates a pressure in a fluid chamber, which may eventually lead to the ejection of a droplet of a fluid through the orifice. In thermal ink jet, the fluid is locally heated, such that the fluid is locally converted into a vapor. This evaporation of a part of the fluid generates a force, which may eventually lead to the ejection of a droplet of a fluid through the orifice.

However, both techniques are not suited for operation at high temperature. Thermal ink jet is only suited for ejecting fluids, having a relatively low boiling point, because this technique requires the evaporation of a part of the fluid to generate a force in the fluid. Piezoelectric elements cannot operate at very high temperatures and are therefore not suited for ejecting droplets of a fluid at high temperature.

WO 2010063576 describes a device for jetting droplets of a fluid at a high temperature, wherein the fluid is actuated by generating a Lorentz force in the fluid. The device is suited to eject droplets of fluid at a high temperature. A Lorentz force is generated in the fluid, by applying an electrical pulse to the fluid, the fluid being positioned in a magnetic field. A Lorentz force can only be generated if the fluid is an electrically-conductive fluid. In WO 2010063576, a device for jetting droplets of an electrically-conductive fluid, is disclosed. However, the device disclosed in WO 2010063576 is not suited to jet droplets of an electrically non-conductive fluid. In this device, the actuation means, provided for actuating the electrically conductive fluid is positioned in close proximity to the orifice. As a consequence, droplets of an electrically non-conductive fluid cannot be jetted by the device according to WO 2010063576.

It is an object of the invention to provide a device for ejecting droplets of an electrically non-conductive medium having a high melting point at high temperature.

SUMMARY OF THE INVENTION

The above object is achieved in a device for ejecting droplets of an electrically non-conductive fluid at a temperature of 360° C. or above, the device comprising;

a fluid chamber body having a fluid chamber for containing the electrically non-conductive fluid at a temperature of 360° C. or above and for containing a conductive medium, the fluid chamber body being made of a heat resistant material, the fluid chamber body comprising an orifice extending from the fluid chamber to an outer surface of the fluid chamber body, the fluid chamber being defined such that when the fluid chamber comprises the conductive medium and the electrically non-conductive fluid, the electrically non-conductive fluid and the conductive medium are substantially non-mixed, and at least a part of the electrically non-conductive fluid is positioned in the fluid chamber closer to the orifice than the conductive medium;

actuation means for actuating the conductive medium, the actuation means comprising at least an electrode for providing an electric current through the conductive medium and a magnet, for providing a magnetic field in the conductive medium;

heating means for providing heat to an electrically non-conductive medium to melt, forming the electrically non-conductive fluid and heating the electrically non-conductive fluid to a temperature of 360° C. or above.

The device according to the present invention comprises a fluid chamber body defining a fluid chamber and having an orifice extending from the fluid chamber to an outer surface of the fluid chamber element. The fluid chamber is configured to comprise both the electrically non-conductive medium and the conductive medium. The fluid chamber is made of heat-resistant material, because it is configured to comprise a fluid at a temperature of 360° C. or above and has to withstand these high temperatures. The fluid chamber body comprises an orifice, the orifice extending from the fluid chamber to an outer surface of the fluid chamber body. Hence, a droplet of fluid may be ejected from the fluid chamber body via the orifice. The electrically non-conductive fluid is a fluid having an electric conductivity that is too low to generate a Lorentz force that is strong enough to eject a droplet of the molten medium through the orifice, upon applying a certain current, in a given magnetic field and geometry of the fluid chamber body. Thus, the person skilled in the art will be able to judge whether a fluid is electrically conductive or electrically non-conductive in accordance with the present invention, based on his/her judgment on what current and magnetic field may be applied and on what the geometry of the fluid chamber body is.

The electrically non-conductive medium and the conductive medium are positioned such, that at least a part of the electrically non-conductive medium is positioned closer to the orifice than the conductive medium. As a consequence, if a droplet of fluid is ejected through the orifice, a droplet of electrically non-conductive fluid is ejected and the conductive medium stays within the fluid chamber. The electrically non-conductive fluid and the conductive medium are substantially non-mixed. If they would be mixed, a droplet, consisting of a mixture of the electrically non-conductive fluid and the conductive medium could be ejected and the electrically non-conductive fluid, ejected from the orifice, would be contaminated with the conductive medium.

The device further comprises actuation means for actuating the conductive medium. As mentioned above, actuation of a fluid by applying a Lorentz force is a suitable method of actuation, also at higher temperatures. Since a Lorentz force cannot be applied to actuate the actual electrically non-conductive medium, a conductive medium is used. The conductive medium is positioned in a magnetic field, the magnetic field being provided by a magnet. Also electrodes are provided for providing an electric current through the conductive medium. By applying an electric current to the conductive medium that is positioned in a magnetic field, a Lorentz force is generated in the conductive medium, as the Lorentz force is related to the electric current and the magnetic field vector; $\bar{F}=\bar{I}\times\bar{B}$. The Lorentz force may generate a volume force in the conductive medium, causing a motion in the conductive medium. Since the conductive medium is positioned further away from the orifice than at least a part of the electrically non-conductive medium, the motion generated in the conductive medium does not result in ejection of a part of the conductive medium through the orifice. Instead, by the motion in the conductive medium, the conductive medium is moved in the direction of the interface with the electrically non-conductive medium and the force generated in the conductive medium is transferred to the electrically non-conductive medium. This force causes a motion in the electrically non-conductive medium. This motion causes differences in pressure throughout the electrically non-conductive medium, also known as a pressure wave. The motion in the electrically non-conductive medium may result in the ejection of a droplet of this fluid through the orifice.

Furthermore, the device comprises heating means for providing heat to an electrically non-conductive medium to melt, forming the electrically non-conductive fluid and heating the electrically non-conductive fluid to a temperature of 360° C. or above.

In an embodiment, the fluid chamber body is made of a heat conductive material. The advantage of the fluid chamber body being made of a heat conductive material is that heat may be more easily supplied to the electrically non-conductive medium via the fluid chamber body to keep the electrically non-conductive medium at the desired temperature. Moreover, it is also more easy to melt the electrically non-conductive medium, thereby forming the electrically non-conductive fluid if the fluid chamber body is made of a heat conductive material. Please note that also the geometry and the thickness of a wall of the fluid chamber body may be suitably selected in order to optimize the heat conductivity of the fluid chamber body.

In an embodiment, the device is adapted to eject droplets of an electrically non-conductive fluid at a temperature of 500° C. or above. It will be obvious to the person skilled in the art that to eject fluid at a temperature of 500° C. or above, the requirements to the device and in particular, to the fluid chamber body with respect to e.g. heat resistance are more stringent than for a device, in which a fluid is ejected at 360° C. Therefore, it will be clear to the person skilled in the art that suitable adjustments have to be made to the device adapted to eject droplets of an electrically non-conductive fluid, in order to be able to jet the droplets of said fluid at a temperature of 500° C. or above.

In an embodiment, the electrically non-conductive medium is molten glass. Ejection of droplets of molten glass provide the possibility to apply small particles of glass, for example small spheres of glass, onto a receiving medium.

Glass consists of silica ($SiO_2$). The melting point of pure silica is over 1700° C. However, usually other components (additives) are added to the silica when making glass. These additives change the melting temperature of the glass. Therefore, the melting temperature of glass depends on the nature and the amount of the additives added to the silica. Sodium carbonate and calcium carbonate are often used as additives. The melting point of common types of glass is usually 800° C. at minimum. Furthermore, the melting point of the common types is glass is usually not higher than 1700° C. However, also glass types having a lower or higher melting point are known. For example, fused quartz has a melting point of about 1750° C. In order to eject droplets of glass, the glass has to be molten. As a consequence, it is necessary to keep the glass at a temperature at least equal to the melting temperature of the glass.

In an embodiment, the conductive medium is a molten metal. A molten metal, onto which a Lorentz force is generated is a suitable actuation means for actuating the electrically non-conductive medium. Metals are electrically conductive. Consequently, by placing the metal in a magnetic field and applying an electric current to the metal, a Lorentz force may be generated in the metal. When the metal is molten, the molecules of the metal are free to move with respect to one another. Therefore, the metal mass may be easily deformed in case the metal is molten. By applying a Lorentz force onto the molten metal, the metal may deform. This deformation may apply a force onto another object adjacent to the molten metal. This object may be an electrically non-conductive medium. The force, applied to the electrically non-conductive medium by the deformation of the mass of fluid metal, may generate a movement within the electrically non-conductive medium which may result in ejection of a droplet of the electrically non-conductive medium through the orifice.

In a particular embodiment, the molten metal is selected based on its properties, such as boiling point, melting point, the electrical conductivity, etc. The melting point of the metal is below the jetting temperature. The metal should preferably be chosen such, that the melting point of the metal is below the melting point of the electrically non-conductive medium. The boiling point of the metal is preferably above the jetting temperature of the electrically non-conductive fluid. The electrical conductivity of the metal should be high. The higher the electrical conductivity of the metal, the more efficient a Lorentz force can be generated in the metal.

Furthermore, the interaction between the electrically non-conductive fluid and the molten metal is important. The electrically non-conductive fluid and the molten metal should be substantially non-mixed during jetting.

In a particular embodiment, the molten metal and the electrically non-conductive medium are separated by a suitable membrane. The non-electrically fluid and the molten metal should be substantially non-mixed, as explained above. A membrane may be a suitable means for preventing the electrically non-conductive medium and the molten metal to mix, because the membrane prevents the two fluids from contacting one another. On the other hand, the membrane is flexible and may be deformed. It may for example be deformed by the forces applied onto the membrane by the deformation of the molten metal upon generation of a Lorentz force within the molten metal. The deformation of the membrane may provide a force within the electrically non-conductive medium, which causes a pressure wave within the electrically non-conductive medium. Because of the pressure wave, generated in the fluid, a droplet of the fluid may be ejected through the orifice. In summary, the suitable membrane should at least be heat resistant, be deformable at high temperatures and be resistant to both the conductive medium and the electrically non-conductive fluid, also at the elevated temperatures at which the device is operated. The person skilled in the art may suitably select a suitable membrane, based on these criteria and based on the nature of the conductive medium and the electrically non-conductive medium used, for example in a text book. An example of a suitable membrane may be a thin layer of silicon. Alternatively, the membrane may be a fluid membrane, the fluid membrane consisting of a fluid that does not mix with the molten metal and does not mix with the electrically non-conductive fluid, either. A fluid membrane, because of its fluid character, is easily deformable by the force applied by the molten metal and consequently, the electrically non-conductive fluid may be actuated.

In an embodiment, the fluid chamber body is electrically conductive and the heating means comprise an induction coil generating an induction current in the fluid chamber body for heating the body and thereby heating the electrically non-conductive medium. The electrically non-conductive medium, positioned within the fluid chamber body, should be at a temperature of at least 360° C. To keep the electrically non-conductive medium at this high temperature and optionally to melt the electrically non-conductive medium, forming the electrically non-conductive fluid, heat needs to be applied to the medium. The higher the temperature difference between the fluid and the environment, the more energy is lost to the environment and the more heat needs to be applied to the fluid to keep the fluid at the desired temperature. An electrically non-conductive object cannot be heated using induction directly. However, the electrically non-conductive medium may be heated indirectly using inductive heat by providing the fluid chamber body with heating means, the heating means comprising an induction coil generating an induction current. Provided that the fluid chamber body is electrically conductive, the fluid chamber body may be heated by the induction current generated by the inductive coil and the fluid chamber body, comprising the electrically non-conductive medium, may transfer the heat to the electrically non-conductive medium, thereby heating the fluid.

In an embodiment, the heating means comprises at least an induction coil, the coil being positioned around at least a part of the fluid chamber body for providing inductive heat to the conductive medium, the induction coil being configured to carry an electrical current for inducing an inductive current in the material of the conductive medium for heating the material of the fluid. The conductive medium may not only be used to generate a force in the electrically non-conductive medium, it may also be used to heat the fluid. In case an inductive coil is positioned around at least a part of the fluid chamber body where the conductive medium is positioned, then, upon applying a current to the induction coil, an inductive current is generated in at least a part of the conductive medium. When the conductive medium is heated to a higher temperature than its environment, the conductive medium dissipates heat to its environment. If the electrically non-conductive medium is close to the conductive medium, the conductive medium may heat up the electrically non-conductive medium. The conductive medium may be a metal. Metals are not only good electric conductors, they are also good thermal conductors. Thus, warming the conductive medium may be an efficient way of providing heat to the non-electrically conductive fluid, keeping the electrically non-conductive medium at the right temperature.

BRIEF DESCRIPTION OF THE DRAWINGS

These and further features and advantages of the present invention are explained hereinafter with reference to the accompanying drawings showing non-limiting embodiments and wherein.

DETAILED DESCRIPTION OF THE DRAWINGS

Figure 1A:
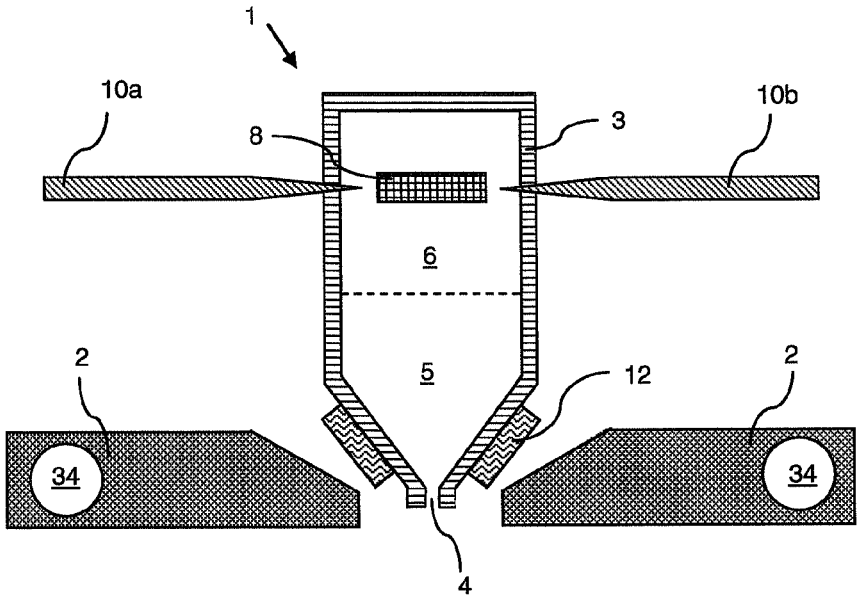
FIG. 1A shows a cross-sectional view of a first embodiment of the device for jetting droplets of an electrically non-conductive medium at a temperature of 360° C. or above.

In the drawings, same reference numerals refer to same elements.

FIG. 1A shows a cross-sectional view of a part of a device 1 for ejecting droplets of an electrically non-conductive medium at a temperature of 360° C. or above, for example droplets of glass. The jetting device 1 comprises a support frame 2, made of a heat resistant material for supporting the fluid chamber body 3. Optionally, the support frame 2 may be cooled by a cooling liquid, which may flow through cooling channels 34. A good heat conductivity increases the heat distribution through the support frame 2 and thereby increases a spreading of the heat. Further, the support frame 2 is preferably configured to absorb only a relatively small amount of heat from any of the heated parts of the jetting device 1. For example, the support frame 2 may be made of aluminum and be polished such that the aluminum reflects a relatively large amount, e.g. 95% or even more, of the heat radiation coming from any hot parts of the jetting device 1.

The device for ejecting droplets 1 is provided with an orifice 4 through which a droplet of the fluid may be ejected. The orifice 4 is a through hole extending through a wall of a fluid chamber body 3. In the fluid chamber body 3 a fluid chamber is arranged. The fluid chamber 3 is configured to hold the conductive medium and the electrically non-conductive medium at a temperature of 360° C. or above. Furthermore, the fluid chamber 3 is arranged to, when containing both the electrically non-conductive fluid and the conductive medium, contain the electrically non-conductive medium and the conductive medium in a substantially non-mixed state. Moreover, at least a part of the electrically non-conductive medium is positioned in the fluid chamber body 3 at a position closer to the orifice 4 than the conductive medium. In the embodiment of the jetting device 1 shown in FIG. 1A, the fluid chamber is arranged to contain the electrically non-conductive medium in a first part 5 of the fluid chamber body 3 and to contain the conductive medium in a second part 6 of the fluid chamber body. The second part 6 of the fluid chamber body 3 is positioned further away from the orifice 4 than the first part 5 of the fluid chamber body. Since the fluid chamber body 3 is configured to contain the electrically non-conductive medium at a temperature of 360° C. or above, the fluid chamber body 3 needs to be heat resistant. Further, the fluid chamber body 3 is made such that the electrically non-conductive medium, such as glass, is enabled to flow over a surface, in particular an inner surface of the fluid chamber body 3, the inner surface forming a wall of the fluid chamber. Also, an inner wall of the through hole forming the orifice 4 needs to be wetting for the fluid in order to enable the fluid to flow through the orifice 4. If the surface of the fluid chamber body 3 is wetting with respect to the fluid, the fluid will not tend to form beads, but will easily spread and flow over the surface and is thus enabled to flow into and through the orifice 4.

As explained above, conventional techniques for actuating the electrically non-conductive medium, such as thermal inkjet or piezoelectric inkjet are not suited for jetting at high temperatures, such as temperatures of 360° C. or above. Therefore, in accordance with the present invention, the electrically non-conductive medium is actuated by a conductive medium, to which a Lorentz force is applied. For applying a Lorentz force in the conductive medium, the jetting device 1 is provided with two permanent magnets 8. Optionally, the magnets 8 may be arranged between two magnetic field concentrating elements (not shown), for example magnetic field concentrating elements made of a magnetic field guiding material such as iron. The jetting device 1 is further provided with two electrodes 10*a*, 10*b* (hereinafter also referred to as electrodes 10) both extending into the fluid chamber body 3 through a suitable through hole such that at least a tip of each of the electrodes 10 is in direct electrical contact with the conductive medium present in the fluid chamber 3. The electrodes 10 are supported by suitable electrode supports 14 and are each operatively connected to a suitable electrical current generator (not shown) such that a suitable electrical current may be generated through the electrodes 10 and the conductive medium present between the tips of the electrodes 10. Optionally, the magnets 8 may be cooled by suitable cooling means.

The electrodes 10 are made of a suitable material for carrying a relatively high current, while being resistant against high temperatures. The electrodes 10 may be suitably made of tungsten (W), although other suitable materials are contemplated.

The device 1 is further provided with heating means 12 for heating the electrically non-conductive medium at a temperature of 360° C. or above and/or keeping the fluid at a temperature of 360° C. or above. The heating means 12 may heat the electrically non-conductive medium directly or may heat the fluid chamber body 3, containing the electrically non-conductive medium, as shown in FIG. 1A. The heating means 12 may be electrical heating means, inductive heating means or a flame, for example.

Figure 1B:
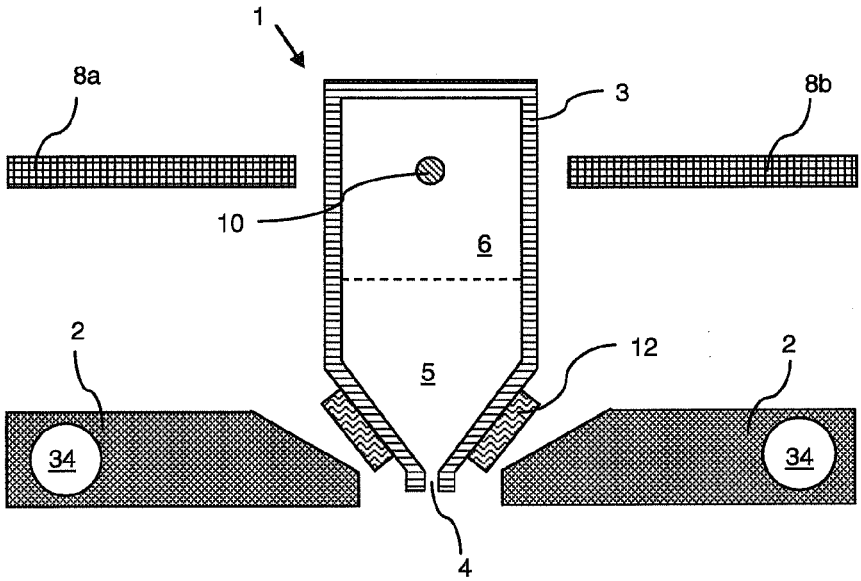
FIG. 1B shows a second cross-sectional view of a first embodiment of the device for jetting droplets of an electrically non-conductive medium at a temperature of 360° C. or above.

FIG. 1B shows a cross-sectional view of the device as shown in FIG. 1A, wherein the cross-section is shown at a position turned 90° with respect to the cross-sectional view of FIG. 1A. In contrast to FIG. 1A, the two magnets 8*a*, 8*b* (now referred to as magnets 8) are visible. The two magnets 8 are positioned perpendicular with respects to the two electrodes 10. In FIG. 1B, the electrodes 10 are positioned perpendicular with respect to the cross-section. The electrodes 10 and the magnets 8 are positioned perpendicular with respect to one another to maximize the Lorentz force obtained when applying a current to the conductive medium, placed in the magnetic field. The electrically non-conductive medium may be placed in the magnetic field, but this is not necessary.

Figure 2:
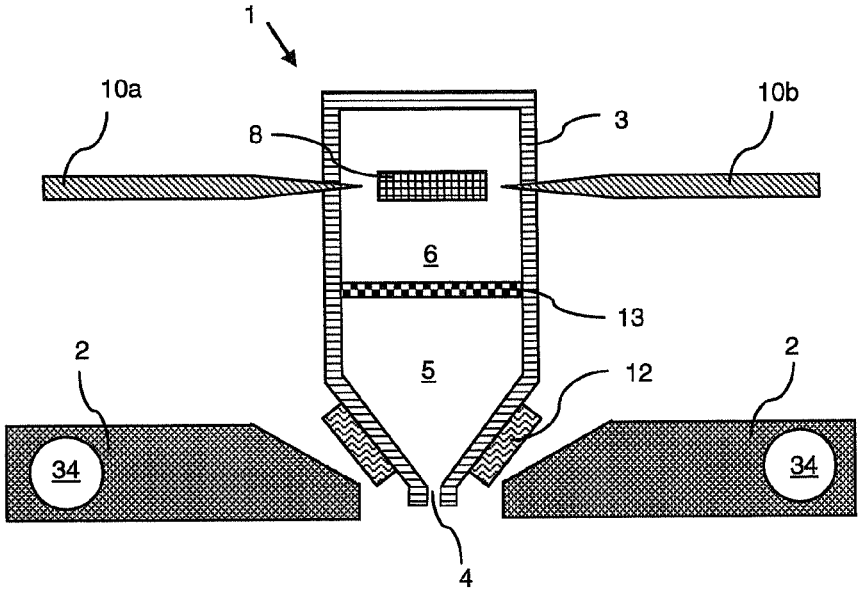
FIG. 2 shows a cross-sectional view of a second embodiment of the device for jetting droplets of an electrically non-conductive medium at a temperature of 360° C. or above.

FIG. 2 shows a second embodiment of the device 1 in accordance with the present invention. The fluid chamber body 3 is configured to contain both the electrically non-conductive medium and the conductive medium. As explained above it is important that the fluid and the medium do not mix, in order to prevent contamination of the electrically non-conductive medium that is to be jetted. The electrically non-conductive medium is contained in the first part 5 of the fluid chamber body 3, whereas the conductive medium is contained in the second part 6 of the fluid chamber body 3. The fluid and the medium may stay separated, for example because of a difference in density and/or the fluid and the medium being immiscible. However, at high temperatures, especially when forces are applied to the conductive medium and the electrically non-conductive medium, the medium and the fluid may be mixed to some extend. Therefore, it may be advantageous to separate the fluid and the medium. However, the separation means should be flexible, otherwise the Lorentz force generated in the conductive medium cannot be used to actuate the fluid. Therefore, the fluid chamber body 3 may be supplied with a suitable membrane 13, as shown in FIG. 2. The membrane 13 prevents the medium and the fluid to be in direct contact. However, the membrane 13 may be deformed, upon applying a force onto the membrane. As a consequence, a Lorentz force generated in the conductive medium may deform the membrane 13. The deformation of the membrane 13 may subsequently apply a force onto the electrically non-conductive medium, generating a pressure wave in the fluid, which may lead to the expulsion of a droplet of fluid through the orifice 4. Obviously, the membrane 13 should be resistant to high temperatures.

Figure 3:
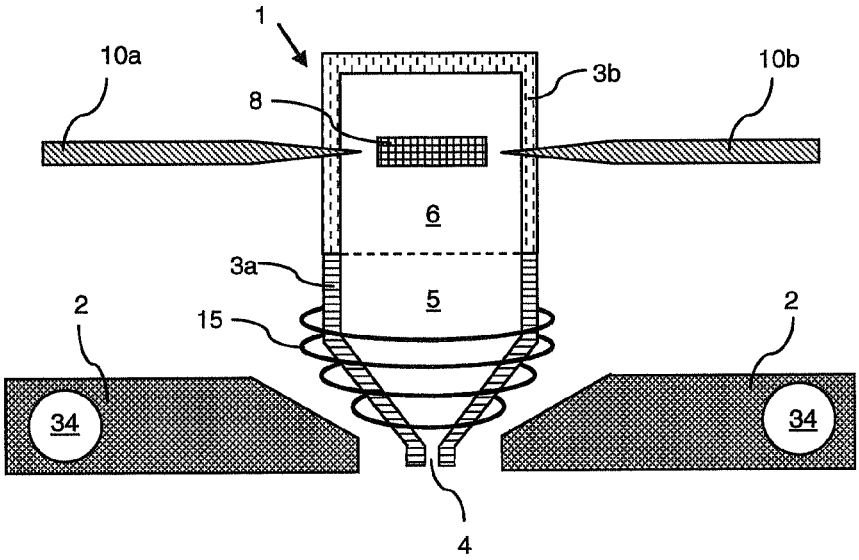
FIG. 3 shows a cross-sectional view of a third embodiment of the device for jetting droplets of an electrically non-conductive medium at a temperature of 360° C. or above.

FIG. 3 shows the device 1 for jetting droplets of an electrically non-conductive medium, using a Lorentz force generated in the conductive medium. An induction coil 15 is shown. The first part 5 of the fluid chamber body 3 is arranged in a centre of the induction coil 15. The first part 5 of the fluid chamber body 3 is made of an electrically-conductive material. Optionally, the entire fluid chamber body 3 may be made of an electrically-conductive material. The first part 5 of the fluid chamber body 3 is arranged such that a current flowing through the induction coil 15 results in heating of a first part 5 of the fluid chamber body 3. In case the first part 5 of the fluid chamber body 3 comprises the electrically non-conductive medium, or alternatively, the solidified electrically non-conductive medium, the heat generated in the first part 5 of the fluid chamber body 3 is transferred to the electrically non-conductive medium. As a consequence, the electrically non-conductive medium may be heated to a temperature of 360° or above, and may be kept at a temperature of 360° C. or above. Optionally, the electrically non-conductive medium may be molten, in case it was solidified. The first part 5 of the fluid chamber body 3 may be heated selectively, or also the second part 6 of the fluid chamber body 3 may be heated (partially). Such inductive heating ensures a power-efficient heating and no contact between any heating element and the electrically non-conductive medium or the conductive medium, limiting a number of (possible) interactions between elements of the jetting device 1, the electrically non-conductive medium and the conductive medium.

Figure 4:
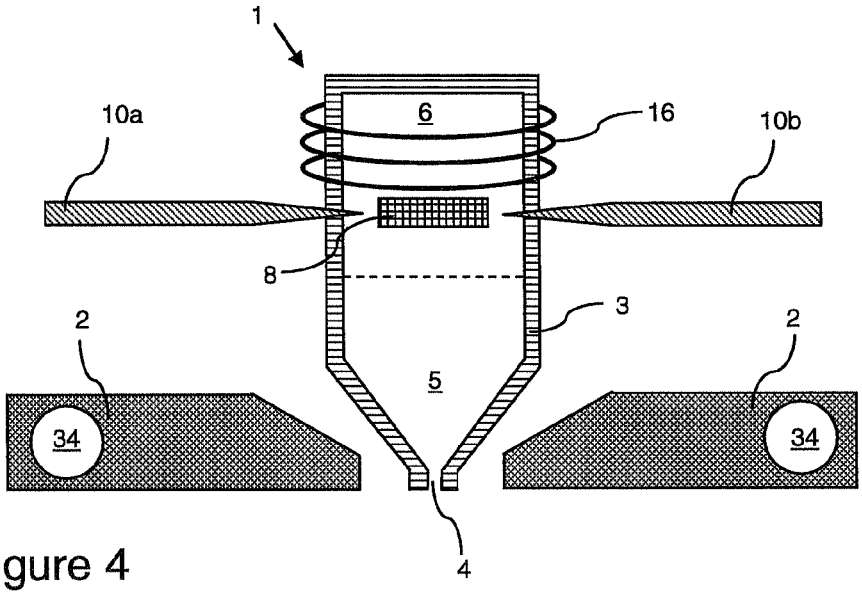
FIG. 4 shows a cross-sectional view of a fourth embodiment of the device for jetting droplets of an electrically non-conductive medium at a temperature of 360° C. or above.

FIG. 4 shows another embodiment of the jetting device 1 for jetting droplets of an electrically non-conductive medium, using a Lorentz force generated in the conductive medium, wherein inductive heating is applied. In FIG. 4, the second part 6 of the fluid chamber body 3 is positioned in the centre of an induction coil 16. By applying a current to the induction coil 16, the conductive medium is heated by the inductive heat generated by the induction coil 16. In an embodiment of the present invention, the conductive medium may be a molten metal. In order to get the metal in a molten state and prevent them from solidifying, heat needs to be supplied to the metal. Heat may be efficiently supplied to the metal by inductive heating.

Moreover, the heat of the conductive medium may be transferred to the electrically non-conductive medium and as a consequence, the warm conductive medium, heated by means of the induction coil 16 may be used as a heating means for heating the electrically non-conductive medium to the desired temperature. It will be clear to the person skilled in the art that heating means may be combined to efficiently heat the electrically non-conductive medium, for example both the conductive medium and the fluid chamber body 3 may be heated, thereby indirectly heating the electrically non-conductive medium.

Figure 5:
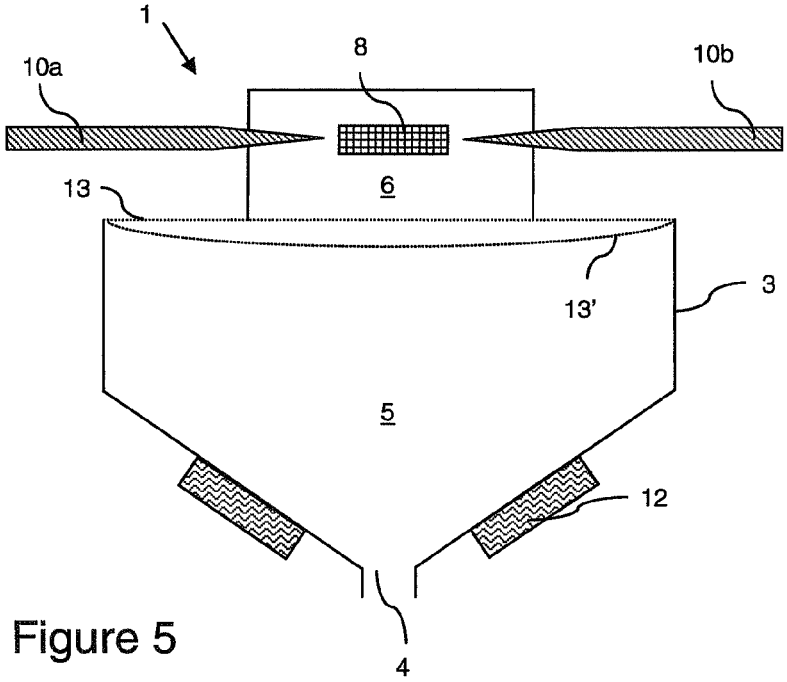
FIG. 5 shows a cross-sectional view of a fifth embodiment of the device for jetting droplets of an electrically non-conductive medium at a temperature of 360° C. or above.

FIG. 5 shows a fifth embodiment of the jetting device 1 for jetting droplets of an electrically non-conductive medium. The first part 5 of the fluid chamber body 3 comprises the electrically non-conductive medium. The second part 6 of the fluid chamber body comprises the electrically conductive medium, such as a molten metal. The fluid chamber body 3 is provided with suitable heating means 12. On the side of the first part 5 of the fluid chamber body 3, facing the second part 6 of the fluid chamber body 3, a membrane 13 is provided. The membrane 13 is larger than the second part 6 of the fluid chamber body 3. Upon applying a Lorentz force onto the electrically conductive medium, the membrane 13 deforms. The deformed membrane 13' is schematically shown in FIG. 5. Since the membrane 13 is larger than the second part 6 of the fluid chamber body 3, the membrane 13 may deform with a larger amplitude upon application of the Lorentz force onto the electrically conductive medium than in case the membrane 13 would have the same dimensions as the second part 6 of the fluid chamber body 3. As a consequence, a larger volume displacement may be achieved when using a membrane 13 that is larger than the second part 6 of the fluid chamber body, because of both the larger size of the membrane and its larger amplitude upon actuation. Therefore, a higher pressure may be generated in the first part 5 of the fluid chamber body 3, resulting in more efficient ejecting of droplets of the electrically non-conductive fluid. In case it is necessary to use a less flexible membrane 13, for example to prevent the membrane 13 from breaking, the amplitude with which the membrane 13 deforms upon actuation may be smaller than the amplitude of a more flexible membrane 13. Increasing the size of the membrane may be a suitable way of compensating for the smaller amplitude, because the smaller amplitude may be suitably compensated for by providing a membrane 13 having a larger size. Thus, the volume displacement may be kept constant when changing the flexibility of the membrane 13 by suitably adapting the size of the membrane 13.

Please note that the magnitude of the pressure that is build up in the electrically conductive medium by generating a Lorentz force depends on the geometry of the second part 6 fluid chamber body 3. The smaller the dimensions of the second part 6 of the fluid chamber body 3, in particular the smaller the length of the second part 6 of the fluid chamber body 3 in a direction parallel to the direction of the magnetic field, the larger the pressure that is build up. Thus, it will be clear to the person skilled in the art that the magnitude and geometry of both the first part 5 and the second part 6 of the fluid chamber body have to be suitably selected in order to optimize the performance of the jetting device 1 in accordance with the present invention.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed. Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention claimed is:

1. A device for ejecting droplets of an electrically non-conductive fluid at a temperature of 360° C. or above, the device comprising:

a. a fluid chamber body having a fluid chamber for containing the electrically non-conductive fluid at a temperature of 360° C. or above and for containing a conductive medium, the fluid chamber body being made of a material that is heat conductive and heat resistant, the fluid chamber body comprising an orifice extending from the fluid chamber to an outer surface of the fluid chamber body, the fluid chamber being defined such that when the fluid chamber comprises the conductive medium and the electrically non-conductive fluid, the electrically non-conductive fluid and the conductive medium are substantially non-mixed, and at least a part of the electrically non-conductive fluid is positioned in the fluid chamber closer to the orifice than the conductive medium;

b. an actuation element configured to actuate the conductive medium, the actuation element comprising at least one electrode for providing an electric current through the conductive medium and a magnet, for providing a magnetic field in the conductive medium, wherein the at least one electrode is in direct electrical contact with the conductive medium; and c. a heater configured to provide heat to an electrically non-conductive medium to melt, forming the electrically non-conductive fluid and heating the electrically non-conductive fluid to a temperature of 360° C. or above.

2. The device according to claim 1, wherein the electrically non-conductive medium is molten glass.

3. The device according to claim 1, wherein the conductive medium is a molten metal.

4. The device according to claim 3, wherein the molten metal and the electrically non-conductive medium are separated by a suitable membrane.

5. The device according to claim 1, wherein the fluid chamber body is electrically conductive and wherein the heater comprise an induction coil generating an induction current in the fluid chamber body for heating the body and thereby heating the electrically non-conductive medium.

6. The device according to claim 1, wherein the heater comprises at least an induction coil, the coil being positioned around at least a part of the fluid chamber body for providing inductive heat to the conductive medium, the induction coil being configured to carry an electrical current for inducing an inductive current in the material of the conductive medium for heating the material of the fluid.

7. A device for ejecting droplets of an electrically non-conductive fluid at a temperature of 500° C. or above, the device comprising:

a. a fluid chamber body having a fluid chamber for containing the electrically nonconductive fluid at a temperature of 500° C. or above and for containing a conductive medium, the fluid chamber body being made of a material that is heat conductive and heat resistant, the fluid chamber body comprising an orifice extending from the fluid chamber to an outer surface of the fluid chamber body, the fluid chamber being defined such that when the fluid chamber comprises the conductive medium and the electrically non-conductive fluid, the electrically non-conductive fluid and the conductive medium are substantially non-mixed, and at least a part of the electrically non-conductive fluid is positioned in the fluid chamber closer to the orifice than the conductive medium;

b. an actuation element configured to actuate the conductive medium, the actuation element comprising at least one electrode for providing an electric current through the conductive medium and a magnet, for providing a magnetic field in the conductive medium, wherein the at least one electrode is in direct electrical contact with the conductive medium; and c. a heater configured to provide heat to an electrically non-conductive medium to melt, forming the electrically non-conductive fluid and heating the electrically non-conductive fluid to a temperature of 500° C. or above.

8. The device according to claim 7, wherein the conductive medium is a molten metal.

9. The device according to claim 8, wherein the molten metal and the electrically non-conductive medium are separated by a suitable membrane.

* * * * *